US005631620A

United States Patent [19]

Totsuka et al.

[11] Patent Number: 5,631,620

[45] Date of Patent: May 20, 1997

[54] FUSIBLE LINK AND METHOD OF ASSEMBLING SAME

[75] Inventors: Mitsuhiko Totsuka; Toshiharu Kudo, both of Shizuoka, Japan

[73] Assignee: Yazaki Corporation, Tokyo, Japan

[21] Appl. No.: 458,620

[22] Filed: Jun. 2, 1995

[30] Foreign Application Priority Data

Jun. 15, 1994 [JP] Japan ..... 6-133229

[51] Int. Cl.[6] ..... H01H 85/143

[52] U.S. Cl. ..... 337/260; 337/261; 337/297; 439/621; 29/623

[58] Field of Search ..... 337/142, 147, 337/197, 205, 213, 227, 260–264, 228, 231–240; 439/621–622, 815, 816; 29/623

[56] References Cited

U.S. PATENT DOCUMENTS 4,544,907 10/1985 Takano ..... 337/262

FOREIGN PATENT DOCUMENTS

3740592A1 7/1996 Germany .

4-8244 1/1992 Japan ..... H01H 85/22

*Primary Examiner*—Leo P. Picard

*Assistant Examiner*—Jayprakash N. Gandhi

*Attorney, Agent, or Firm*—Sughrue, Mion, Zinn, Macpeak & Seas

[57] ABSTRACT

There is disclosed a fusible link which obviates the need for a spacer for supporting a fuse element. An insulative housing includes an integral bottom wall through which at least one pair of through holes are formed. A fuse element extends through these through holes, and includes terminal portions and resilient retaining piece portions. The resilient retaining piece portion and the bent terminal portion holds the bottom wall of the housing, thereby retaining the fuse element relative to the housing.

5 Claims, 3 Drawing Sheets

FUSIBLE LINK AND METHOD OF ASSEMBLING SAME

BACKGROUND OF THE INVENTION

1. Field of the Invention

This invention relates to a cartridge-type fusible link used in an electric system of an automobile or the like, and more particularly to a fusible link which can be manufactured at low costs.

2. Related Art

Generally, a cartridge-type fuse element is formed, for example, into a U-shape or a Ω-shape, and therefore in order to retain such a fuse element in an insulative housing, a construction as disclosed in Japanese Utility Model Unexamined Publication No. 4-8244 is known. More specifically, in the construction disclosed in this publication, a fuse element formed into a Ω-shape is inserted into an insulative housing of a tubular shape, and the fuse element is held between the insulative housing and a spacer separate from this housing, and in this condition the insulative housing and the spacer are retained, thereby supporting the fuse element in the insulative housing in a satisfactory manner.

In the conventional construction disclosed in the above publication, however, the separate spacer must be prepared and handled, and therefore the number of the component parts increases, which has resulted in an increased manufacturing cost.

SUMMARY OF THE INVENTION

With the above problem in view, it is an object of this invention to provide a fusible link which can be manufactured at lower costs by obviating the need for a spacer.

Another object is to provide a method of assembling such a fusible link.

According to one aspect of the present invention, there is provided a fusible link comprising a fuse element including terminal portions, the fuse element having resilient retaining piece portions projecting from a surface of the fuse element; and an insulative housing having through holes formed through a bottom wall thereof, wherein at least one of the terminal portions extending respectively through the through holes is bent to be disposed along the bottom wall, and the bent terminal portion and the resilient retaining piece portion hold the bottom wall therebetween to thereby retain the fuse element relative to the insulative housing.

According to another aspect of the present invention, there is provided a fusible link comprising a fuse element including terminal portions, the fuse element having resilient retaining piece portions projecting from a surface of the fuse element; and an insulative housing having through holes formed through a bottom wall thereof, wherein at least one of the terminal portions extending respectively through the through holes is bent to be disposed along the bottom wall, and only the bent terminal portion and the resilient retaining piece portion hold the bottom wall therebetween to thereby retain the fuse element relative to the insulative housing.

According to still another aspect of the invention, there is provided a method of assembling a fusible link, comprising the steps of passing opposite end portions of a U-shaped fuse element respectively through through holes formed through a bottom wall of an insulative housing with a closed bottom from inside the housing; projecting resilient retaining piece portions from a surface of that portion of the fuse element extending outwardly of the bottom wall of the insulative housing; and subsequently pushing the fuse element back into the insulative housing to retain the fuse element relative to the insulative housing.

According to a further aspect of the invention, there is provided a method of assembling a fusible link, comprising the steps of passing opposite end portions of a U-shaped fuse element respectively through through holes formed through a bottom wall of an insulative housing with a closed bottom from inside the housing; projecting resilient retaining piece portions from a surface of that portion of the fuse element extending outwardly of the bottom wall of the insulative housing; and subsequently bending at least one of terminal portions of the fuse element to dispose the bent terminal portion along the bottom wall; and subsequently pushing the fuse element back into the insulative housing to engage the resilient retaining piece portions respectively in retaining grooves formed in the insulative housing and also to hold the bent terminal portion against an outer surface of the bottom wall, thereby retaining the fuse element relative to the insulative housing.

The insulative housing has the closed bottom, and has at its bottom wall the through holes through which the fuse element extends. Therefore, the use of a spacer as employed in the conventional construction is omitted.

Each of the resilient retaining piece portions of the fuse element is engaged in the associated retaining groove open to the through hole in the insulative housing, and the terminal portion is bent to be held against the bottom wall, so that the bottom wall is held between this terminal portion and the resilient retaining piece portion. With this construction, the fuse element can be retained relative to the insulative housing without a spacer.

The resilient retaining piece portion is formed by part of that portion of the fuse element adapted to be passed through the through hole, and is projected generally downwardly. As the resilient retaining piece portion is again introduced into the housing through the through hole, it can be easily deformed resiliently, and then is fitted into the retaining groove upon passing past the through hole.

BRIEF DESCRIPTION OF THE DRAWINGS

FIG. 3(*b*) is a vertical cross-sectional view of an insulative housing;

DESCRIPTION OF THE PREFERRED EMBODIMENTS OF THE INVENTION

One preferred embodiment of a fusible link of the present invention will now be described with reference to FIGS. 1 to 3.

Figure 1:
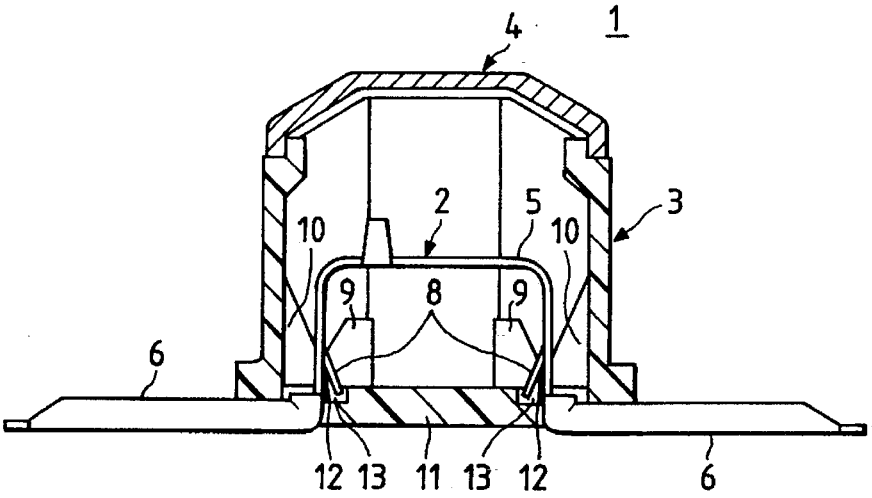
FIG. 1 is a partly vertical cross-sectional view of one preferred embodiment of a fusible link of the present invention.
Figure 2:
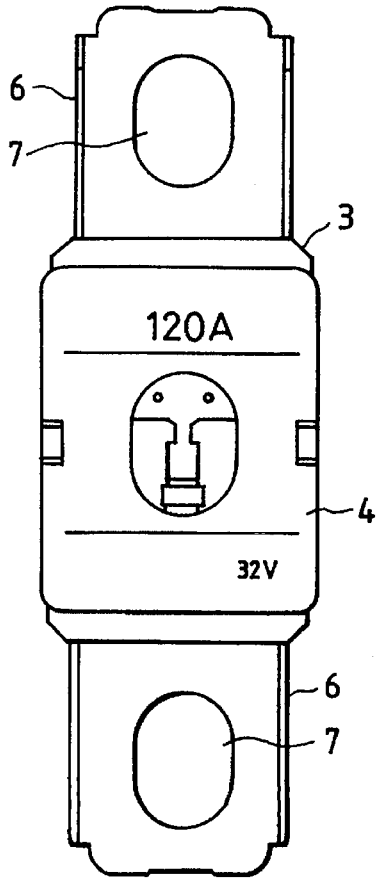
FIG. 2 is a top plan view of the fusible link of FIG. 1.
Figure 3A:
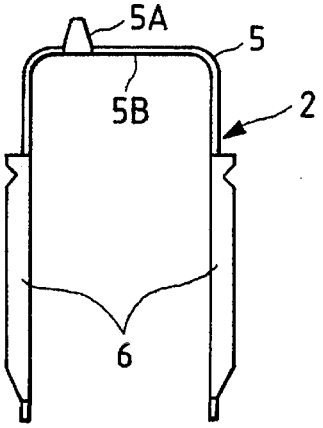
FIG. 3(*a*) is a side-elevational view of a fuse element suitably used in the fusible link of FIG. 1.
Figure 3B:
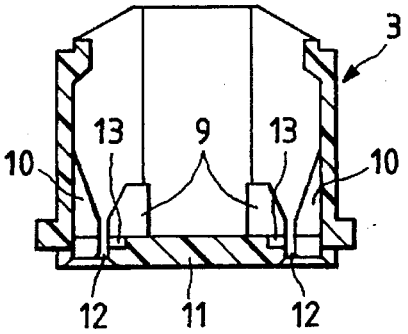

FIG. 1 is a partly vertical cross-sectional view of the fusible link of the invention, FIG. 2 is a top plan view of the fusible link of FIG. 1, FIG. 3(*a*) is a side-elevational view of a fuse element, and FIG. 3(*b*) is a vertical cross-sectional view of an insulative housing.

The fusible link 1 comprises the fuse element 2, the insulative housing 3 with a closed bottom, and a transparent cover 4 fitted on an upper end of the insulative housing 3.

The fuse element 2 in its initial condition is of a U-shaped cross-section, and comprises a fusible conductor portion 5, and a pair of terminal portions 6 extending respectively from opposite ends of the fusible conductor portion 5 as shown in FIG. 3(*a*). The fusible conductor portion 5 comprises a melting portion 5B having a clamping portion 5A of low-melting point metal. A bolt hole 7 (see FIG. 2) for connecting an external terminal is formed through each of the two terminal portions 6, and stamped-out, resilient retaining piece portions 8 are formed respectively at the opposite end portions of the fusible conductor portion 5 disposed adjacent respectively to the two terminal portions 6, each resilient retaining piece portion 8 being able to be projected out of the surface of the associated end portion of the fusible conductor portion 5 as shown in FIG. 1.

As shown in FIGS. 1 and 3(*b*), a pair of holes 12 are formed through a bottom wall 11 of the insulative housing 3 with the closed bottom, and guide ribs 9 and 10 formed on inner surfaces of the housing 3 are slanting toward each of the through hole 12. A pair of retaining grooves 13 are formed in the bottom wall 11, and are disposed adjacent to the through holes 12, respectively, the retaining grooves 13 being open to the through holes 12, respectively.

A method of assembling the fusible link of the invention will now be described with reference to FIGS. 1 and 3 to 5.

Figure 4:
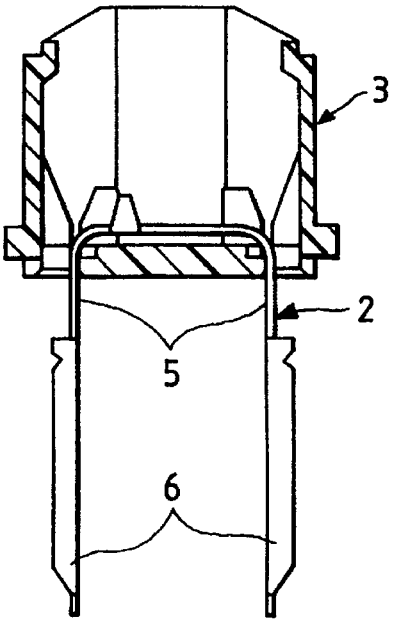
FIG. 4 is a cross-sectional view explanatory of a method of assembling the fusible link of the invention, showing a condition in which the fuse element is inserted into the insulative housing.
Figure 5:
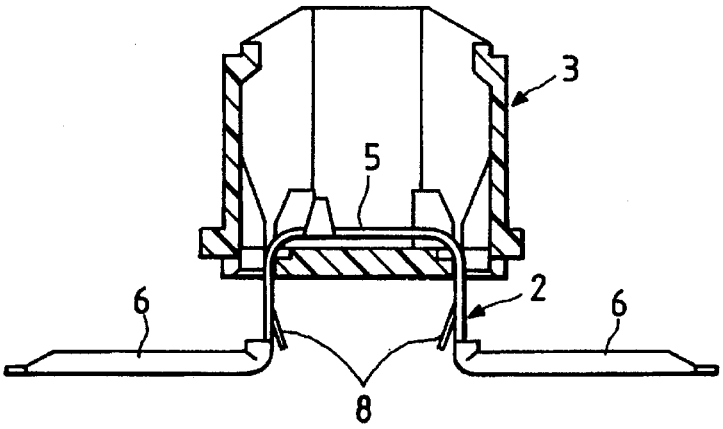
FIG. 5 is a cross-sectional view explanatory of the method of assembling the fusible link of the invention, showing a condition in which the fuse element is shaped into a predetermined configuration.

The fuse element 2, preformed into the configuration shown in FIG. 3(*a*), is inserted into the insulative housing 3 (see FIG. 3(*b*)) through the open top thereof, so that each of the two terminal portions 6 (which constitute the opposite end portions of the element 2, respectively) is moved along the associated guide ribs 9 and 10 to be passed through the associated through hole 12 in the bottom wall 11, so that the inner side of the fusible conductor portion 5 is held in contact with the bottom wall 11, as shown in FIG. 4. Then, each of the resilient retaining piece portions 8, provided adjacent to the respective terminal portions 6, is pushed to be projected inwardly out of the inner surface of the fuse element 2 in a downwardly-slanting manner, as shown in FIG. 5. Simultaneously with the pushing of the resilient retaining piece portions 8, the two terminal portions 6 are bent away from each other at their proximal ends (which are connected to the fusible conductor portion 5) to be disposed in substantially parallel relation to the bottom wall 11. The U-shaped fuse element 2 is pushed upwardly to thereby bring the resilient retaining piece portions 8 into the interior of the insulative housing 3. At this time, each of the resilient retaining piece portions 8 (projecting out of the inner surface of the fuse element 2), while passing through the associated through hole 12, is resiliently deformed by the inner surface of the associated through hole 12, and then is restored to be retainingly engaged in the associated retaining groove 13 when it passes past the through hole 12, as shown in FIG. 1. At this time, the bent terminal portions 6 are held against the outer surface of the bottom wall 11. Finally, the transparent cover 4 is attached to the open top of the insulative housing 3, thus completing the assembling of the fusible link 1.

In the above construction, a downward displacement of the fuse element 2 is prevented by the engagement of the resilient retaining piece portions 8 in the respective retaining grooves 13, and an upward displacement of the fuse element 2 is prevented by the contact of the bent terminal portions 6 with the lower surface of the insulative housing 3.

Namely, the fuse element 2 is provided in such a manner that the resilient retaining piece portions 8 and the terminal portions 6 hold the bottom wall 11 therebetween, and as a result the fuse element 2 is retained in the insulative housing against upward and downward movements. With this construction, the fusible link 1 does not require any spacer as used in the conventional construction, and therefore the number of the component parts is reduced, and besides the fusible link 1 can be easily assembled into a structure of generally the same strength as that of the conventional construction.

Figure 6:
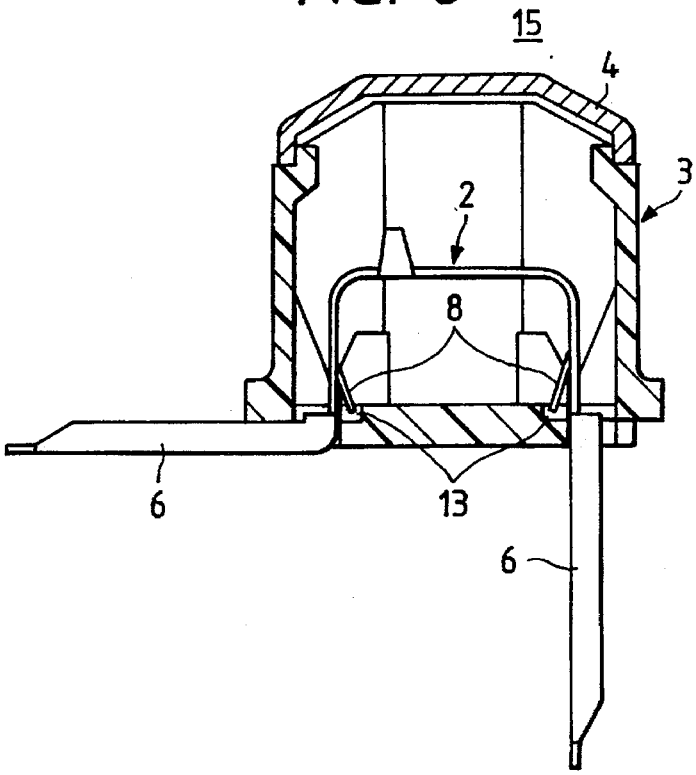
FIG. 6 is a vertical cross-sectional view of a modified fusible link of the invention.

FIG. 6 is a vertical cross-sectional view of a modified fusible link of the invention.

A fuse element 2 of this embodiment differs from that of the preceding embodiment of FIGS. 1 to 3 only in configuration of bending. Therefore, like reference numerals denotes corresponding parts, and explanation of such parts will be omitted.

There are occasions when the fusible link 15 need to be modified in various ways in its mounted condition. In this embodiment, a pair of terminal portions are disposed perpendicularly relative to each other. To obtain such a configuration of the fusible link 15, only one of the terminal portions 6 is bent during the assembling of the fusible link 15. This is achieved because of the provision of the construction in which the fuse element 2 is engaged directly with an insulative housing 3 through resilient retaining piece portions 8 and retaining grooves 13. With this construction, the terminal portions can easily be arranged in a desired manner.

Figure 7:
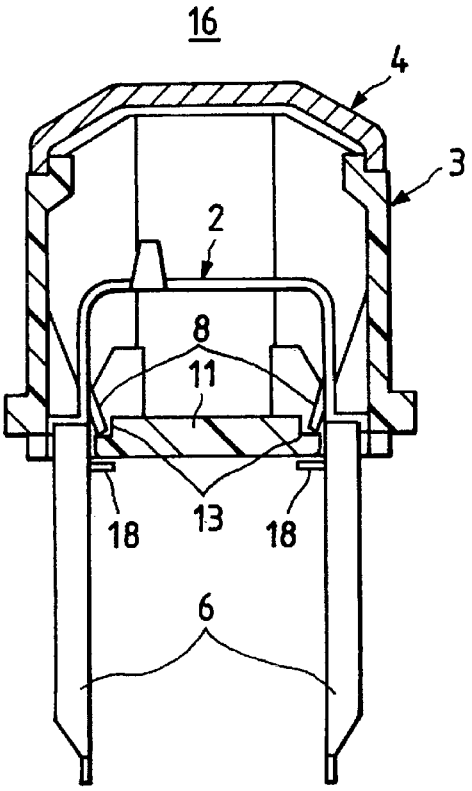
FIG. 7 is a vertical cross-sectional view of another modified fusible link of the invention.

FIG. 7 shows another modified fusible link of the invention.

In this embodiment, the fusible link 16 has a fuse element 2 which is not bent. More specifically, a pair of terminal portions 6 are disposed parallel to each other. Therefore, a pair of additional retaining piece portions 18 are formed on the fuse element 2, and are held against an outer surface of a bottom wall 11 of an insulative housing 3 to prevent an upward movement of the fuse element 2 relative to the insulative housing 3, the retaining piece portions 18 being provided in registry with resilient retaining piece portions 8, respectively. These retaining piece portions 8 and 18 are projected out of the surface of the fuse element when the fuse element 2 is inserted deepest into the insulative housing 3. Then, the assembling is continued as described above.

Figure 8:
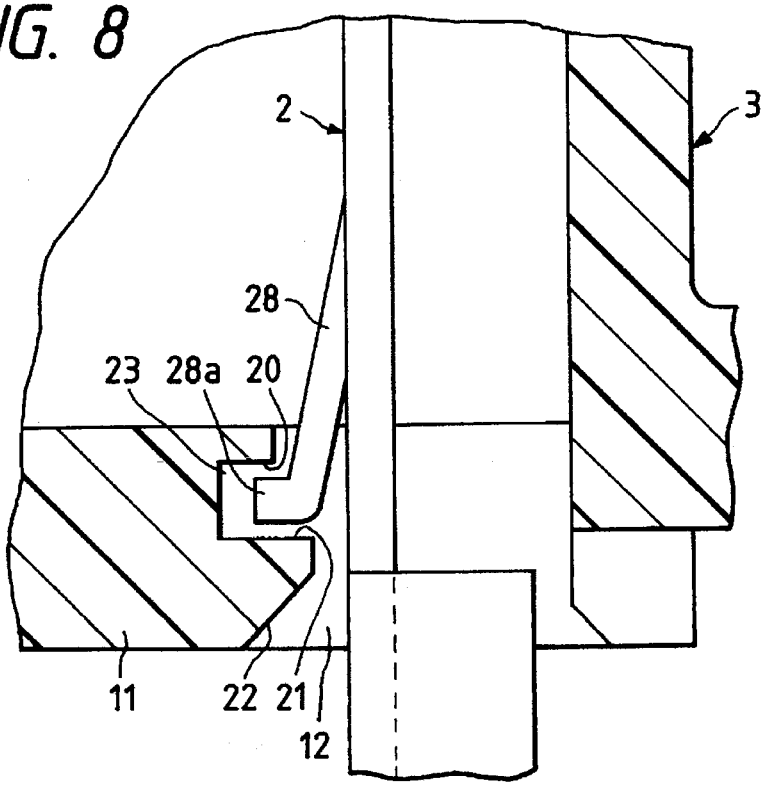
FIG. 8 is a vertical cross-sectional view of an important portion of a further modified fusible link of the invention.

The retaining construction for retaining the fuse element 2 relative to the insulative housing 3 may be of a construction shown in FIG. 8.

In this example, each of resilient retaining piece portions 28, projecting from the surface of a fuse element 2, is bent at its free end to provide a retaining end 28*a* disposed horizontally. A pair of retaining grooves 23 for respectively receiving the retaining ends 28*a* are provided, and each of these grooves 23 is of a channel-shaped cross-section having opposed upper and lower retaining surfaces 20 and 21. A slanting surface 22 is formed in an outer surface of that portion of a bottom wall 11 disposed in registry with the retaining surface 20, and a through hole 12 is increased in size by the provision of the slanting surface 22.

In the above retaining construction, as the fuse element 2 is pushed back into the insulative housing 3, each resilient retaining piece portion 28 comes into sliding contact with the inner surface of the associated through hole 12, and also the retaining end 28*a* comes into sliding contact with the associated slanting surface 22. When this pushing operation further proceeds, the resilient retaining piece portion 28 is projected outwardly out of the surface of the fuse element because of its resiliency, so that the retaining end 28*a* becomes fitted into the retaining groove 23. Thus, in the fusible link, the fuse element 2 is preverted from upward and downward movement relative to the insulative housing 3.

As described above, in the fusible link of the present invention, the fuse element is mounted on the insulative housing having the closed bottom, and the resilient retaining piece portions, projecting from the surface of the fuse element, are engaged respectively in the retaining grooves formed in the insulative housing. With this construction, the use of a spacer as employed in the conventional construction is omitted, and therefore the number of the component parts is reduced, and the manufacturing cost can be reduced.

And besides, since the terminal portions can be shaped or arranged in a desired manner, there is provided the type of fusible link in which there is no need to prepare a plurality of kinds of fuse elements for various purposes.

What is claimed is:

1. A fusible link comprising a fuse element including terminal portions, said fuse element having resilient retaining piece portions projecting from a surface of said fuse element; and an insulative housing integrally formed with a terminal spacer and having through holes formed therethrough wherein at least one of said terminal portions extending respectively through said through holes is bent to be disposed parallel to said terminal spacer and abuts a side wall of said housing so as to prevent displacement relative to said side wall, and said bent terminal portion and said resilient retaining piece portion hold said terminal spacer therebetween to thereby retain said fuse element relative to said insulative housing.

2. A fusible link as recited in claim 1, wherein said terminal spacer further comprises grooves for accepting said resilient portions.

3. The fusible link of claim 2, wherein said housing includes an opening opposing said terminal spacer for inserting said fuse element in a first direction, and wherein said resilient portions engage said grooves so as to prevent displacement of said fuse element in said first direction, and wherein said terminal portion abutting said side wall prevents displacement in a second direction opposite to said first direction.

4. A method of assembling a fusible link, comprising the steps of passing opposite end portions of a U-shaped fuse element respectively through through holes formed through a bottom wall of an insulative housing with a closed bottom from inside said housing; therethrough projecting resilient retaining piece portions from a surface of that portion of said fuse element extending outwardly of said bottom wall of said insulative housing; and subsequently pushing said fuse element back into said insulative housing to retain said fuse element relative to said insulative housing.

5. A method of assembling a fusible link, comprising the steps of passing opposite end portions of a U-shaped fuse element respectively through through holes formed through a bottom wall of an insulative housing with a closed bottom from inside said housing thereafter projecting resilient retaining piece portions from a surface of that portion of said fuse element extending outwardly of said bottom wall of said insulative housing; and subsequently bending at least one of terminal portions of said fuse element to dispose said bent terminal portion along said bottom wall; and subsequently pushing said fuse element back into said insulative housing to engage said resilient retaining piece portions respectively in retaining grooves formed in said insulative housing and also to hold said bent terminal. portion against an outer surface of said bottom wall, thereby retaining said fuse element relative to said insulative housing.

* * * * *